United States Patent [19]

Gosanko et al.

[11] 4,051,615

[45] Oct. 4, 1977

[54] DISPLAY DEVICE AND ARRANGEMENT FOR NEWSPAPERS AND ANALOGOUS ARTICLES

[76] Inventors: Clarence Gosanko, 4551 51st Place, SW., Seattle, Wash. 98116; Robert Weinberg, 6955 SW. Merry Lane, Beaverton, Oreg. 97005

[21] Appl. No.: 657,833

[22] Filed: Feb. 13, 1976

[51] Int. Cl.[2] ..... G09F 1/10

[52] U.S. Cl. ..... 40/10 D

[58] Field of Search ..... 40/16 R, 16.4, 10 D, 40/306, 1.5

[56] References Cited

U.S. PATENT DOCUMENTS

| | | | |
|---|---|---|---|
| 2,449,727 | 9/1948 | Sloane | 40/16 |
| 2,618,086 | 11/1952 | Kmomorous | 40/1.5 |
| 2,723,474 | 11/1955 | Minter | 40/308 |
| 2,888,761 | 6/1959 | Miller | 40/308 |
| 2,930,154 | 3/1960 | Rosen | 40/1.5 |
| 3,082,557 | 3/1963 | Huff | 40/16.4 |
| 3,209,757 | 10/1965 | Littler | 40/10 D |

*Primary Examiner*—Russell R. Kinsey
*Assistant Examiner*—Wenceslao J. Contreras

[57] ABSTRACT

A display device and arrangement for displaying a newspaper or an analogous article includes a folded transparent element which has a generally rectangular front panel and a juxtaposed rear panel. The folded element has an open upper end in the region of its free edges for receiving an article to be displayed intermediate the panels, and a closed lower end in the region of its fold for holding the article in position therein. The folded element is mounted on a support, such as a wire rack.

1 Claim, 4 Drawing Figures

FIG. 1
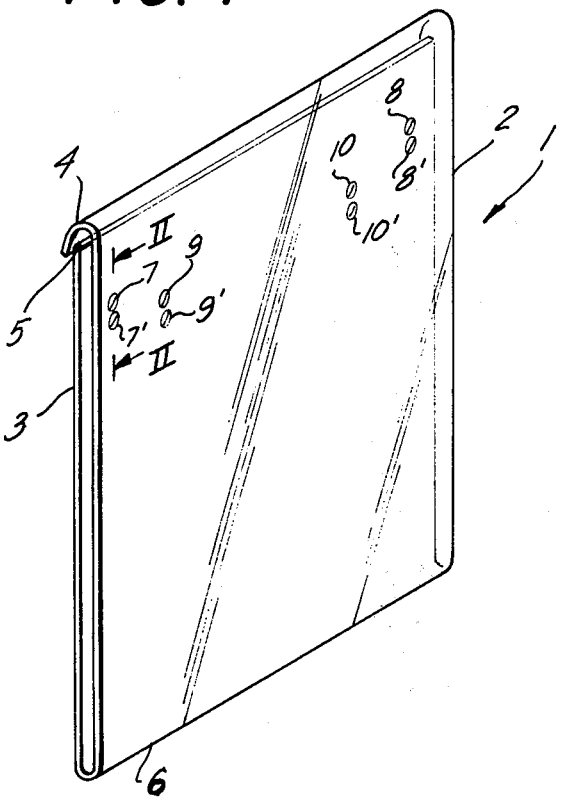
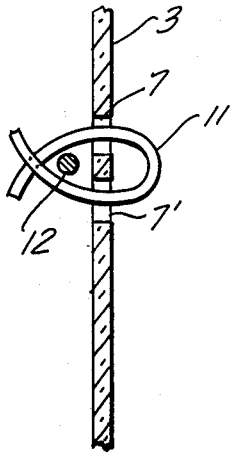
FIG. 2
FIG. 3
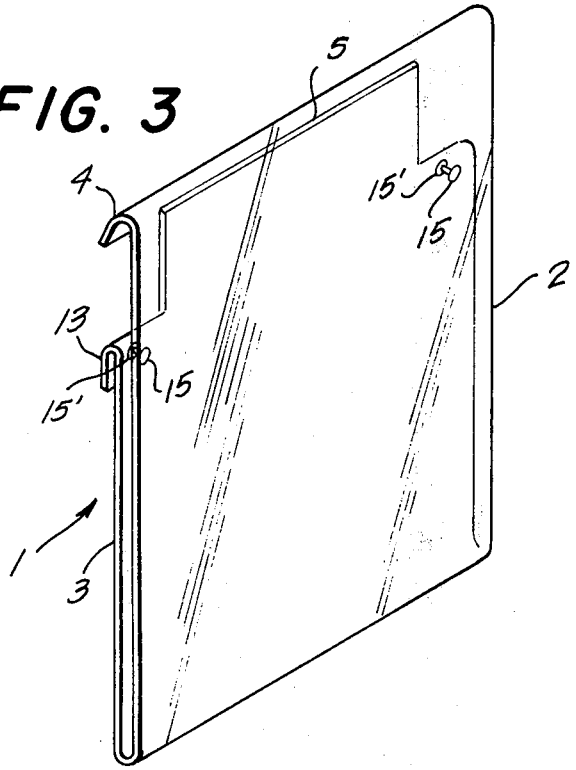
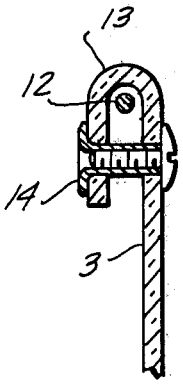
FIG. 4

DISPLAY DEVICE AND ARRANGEMENT FOR NEWSPAPERS AND ANALOGOUS ARTICLES

BACKGROUND OF THE INVENTION

In order to sell newspapers, magazines and other analogous articles, they are frequently arranged horizontally in piles in various retail stores. However, this approach is not altogether adequate, since a buyer must actually walk over to the horizontal piles to actually see the newspapers on display.

Thus, it has been further proposed to arrange newspapers vertically by placing them in racks. Such racks are generally filled with a plurality of newspapers, each newspaper being stacked on its end, one behind the other.

However, very serious difficulties have arisen in vertically displaying a newspaper to the public. It will be appreciated that newspapers are constituted of generally large-sized, non-stiff paper which are not self-supporting. Thus, vertically-arranged papers, and particularly the ones located in front of the vertical stack, tend to flop over so that the front page of the paper is not entirely visible to a buyer. As more and more newspapers are sold from a rack, this effect worsens since the newspapers located in the rear of the rack no longer provide any support for the newpapers located in the front. Without the buyer's attention being adequately directed to the front page of the newspaper, loss of sales will evidently occur.

Another difficulty in displaying newspapers is that other articles may be placed in the rack in front of the newspaper being sold. Such other articles will block the view and, again, results in loss of sales.

SUMMARY OF THE INVENTION

Accordingly, it is the general object of the present invention to overcome the disadvantages of the prior art.

An object of the present invention is to prominently display a newspaper or analogous article in a vertical position.

Another object of the present invention is to constantly display a newspaper or analogous article no matter how many such articles are sold from the rack.

An additional object of the present invention is to protect a newspaper or analogous article from possible damage.

Still another object of the invention is to prevent a newspaper or analogous article from being blocked from view by other articles.

Still a further object of the present invention is to improve sales of newspapers and analogous articles.

In keeping with these objects and others which will become apparent hereinafter, one feature of the invention resides, briefly stated, in a display device and arrangement, particularly for displaying a newspaper or an analogous article which comprises a folded transparent element having a generally rectangular front panel and a juxtaposed rear panel. The folded element has an open upper end in the region of its free edges for receiving an article to be displayed intermediate said panels, and a closed lower end in the region of the fold for holding the article in position therein. Means for mounting the folded element on a support rack are also provided.

Thus, by employing the display device, as just described, and mounting the device on a support structure, such as a conventional wire rack for instance, a newspaper or an analogous article is constantly displayed no matter how many articles may be sold from the rack. By placing the article intermediate the front and rear panels, the article will be protected against possible damage. Moreover, by mounting the display device in front of a rack, the newspaper or analogous article will not be blocked from view, as compared to the prior art, when other articles are placed in front of the newspapers inside the rack.

Another feature of the invention is to provide the front panel of the folded transparent element which is constituted of resilient, synthetic plastic material with a lip portion which generally extends towards the rear panel and overhangs a free edge of the latter. The lip portion cooperatively receives the free edge of the juxtaposed rear panel in a snap-in and snap-out action. Thus, when a newspaper or analogous article is placed intermediate the panels, it will be pressed substantially flat, thereby imparting more prominence to the article itself.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawing.

BRIEF DESCRIPTION OF THE DRAWING

FIG. 1 is a perspective view of the display device according to a first embodiment according to the present invention;

FIG. 2 is a partial view in vertical section of the embodiment of FIG. 1 as seen along the arrows of the line II—II;

FIG. 3 is a perspective view of the display device according to a second embodiment according to the present invention; and FIG. 4 is a side view of FIG. 3 in partial section according to the present invention.

DESCRIPTION OF THE PREFERRED EMBODIMENTS

Referring initially to the display device as illustrated in FIGS. 1 and 3, it will be seen that reference numeral 1 generally identifies a folded transparent element, preferably of resilient, synthetic plastic material which is particularly useful in displaying a newspaper or other analogous article. The transparent element 1 comprises a generally rectangular front panel 2 and a juxtaposed rear panel 3. It will be understood that the article to be displayed is located intermediate panels 2 and 3, as will be described herein.

At the upper end of the element 1 in the region of the free edges of the panels 2 and 3, the front panel 2 has a lip portion 4 which generally extends towards the rear panel 3 and overhangs the free edge 5 of the rear panel 3. Since the folded element is of resilient material, the free edge 5 can be snapped in and out of the overhanging lip portion 4 so as to respectively close and open the upper end of the element 1.

If an article, such as a newspaper, which is generally characterized by the fact that it is not self-supporting since it is made of relatively non-stiff paper, is placed intermediate panels 2 and 3 and subsequently the upper end of the element 1 is closed, then it will be seen that the article is held in position by the fold 6 and effectively pressed flat by the panels 2 and 3. This feature imparts more prominence to the article.

In order to mount the element 1 onto a support, such as a conventional wire rack 12, for display purposes, FIGS. 1 and 2 illustrate a first embodiment according to the invention. The mounting means of FIGS. 1 and 2 comprise a first set of two pairs of holes 7, 7' and 8, 8'. Each pair of holes is located at opposite sides of the rear panel 3 and spaced from each other at a first predetermined distance. This first predetermined distance is selected to correspond to the location of separate wire portions of a conventional wire rack 12. We have found that a spacing of approximately 9¾ inches to be adequate in an application where the article to be displayed is about 11 inches in width by 15 inches in height.

If smaller-sized racks are used, then a second set of two pairs of holes 9, 9' and 10, 10' may be used. The second set is located inwardly of the first set, and each pair is spaced from each other at a second predetermined distance which is smaller than the first predetermined distance. In the purely exemplary example given above, the second predetermined distance would be approximately 5¾ inches.

FIG. 2 is a vertical cross-sectional view of a detail of FIG. 1 and illustrates a preferred way of mounting the element 1 onto the wire support 12. A strap 11 of synthetic plastic material, nylon or the like, is inserted through holes 7 and 7'. The strap 11 has a male plug at one end region which is inserted through a female socket provided at the other end region after the strap 11 has been looped about the wire 12 and tightened sufficiently. The strap 12 may be a conventional stay, as is commonly used in preventing wire from uncoiling.

In the embodiment of FIGS. 3 and 4, the rear panel 3 is not rectangular but is provided with cutouts. A pair of bent lugs 13 is provided at opposite sides of the panel 3 and hook onto the support 12 so as to hold the element 1 in an upright position.

In order to fixedly retain the element 1 onto the support, a pair of first apertures 15 is provided on the rear panel 3, and each of the bent lugs 13 has a second aperture 15' which is juxtaposed with respect to the first apertures 15. Now, with particular reference to FIG. 4, a pair of cylindrical inserts or pins 14 are respectively inserted through apertures 15, 15' to retain the element 1 on the support wire 12. Each insert pin 14 has a first male portion which is threadedly connected with a second female portion.

The support structure 12 is preferably of the wire rack type which is conventionally used in supermarkets for selling the National Enquirer newspaper.

It will be understood that each of the elements described above, or two or more together, may also find a useful application in other types of constructions differing from the types described above.

While the invention has been illustrated and described as embodied in a display device and arrangement for newspapers and analogous articles, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A display device for displaying newspapers and analogous articles on a display rack, comprising an elongated folded element of resilient synthetic plastic material and having a generally rectangular transparent front panel, and a transparent rear panel having a generally rectangular central portion and side portions at opposite sides of the central portion, each side portion having an aperture, said panels being juxtaposed such that respective free portions of the panels form an open upper end at an upper region of the element for receiving an article to be displayed, and said panels being joined along a common unitary edge at a lower region of the element so as to form a closed lower end for holding the article intermediate said panels; means for closing the open upper end of the element, including a resilient, transversely-extending bent lip extending along a common unitary edge with said front panel so as to form therewith a groove for receiving free edge portions of said central portion of said rear panel with snap action to thereby press the article substantially flat for fixing the position of the article intermediate the panels and for imparting prominence to the article; and means on said rear panel in the vicinity of said open upper end for mounting said element in upright position on a rack, including a pair of transversely-extending bent lugs each extending along a common unitary edge with a respective one of said side portions so as to form therewith an open-ended channel for receiving portions of the rack on which the element is to be supported, each bent lug having an aperture which is in alignment with a respective aperture of said side portions, and a pair of retaining inserts each having a threaded member and cooperating mating member which extend through the respective apertures which are in mutual alignment with each other, each of said members having an abutting portion at opposite sides of a respective channel and each extending transversely across the open end of said channel for retaining the element on the rack.

* * * * *